US006813810B2

(12) United States Patent
Beynon

(10) Patent No.: US 6,813,810 B2
(45) Date of Patent: Nov. 9, 2004

(54) VACUUM NOZZLE ASSEMBLY AND SYSTEM

(76) Inventor: Merlin D. Beynon, 4091 S. 420 W., Murray, UT (US) 84123

( * ) Notice: Subject to any disclaimer, the term of this patent is extended or adjusted under 35 U.S.C. 154(b) by 293 days.

(21) Appl. No.: 10/121,937

(22) Filed: Apr. 12, 2002

(65) Prior Publication Data

US 2003/0192143 A1 Oct. 16, 2003

(51) Int. Cl.[7] ..... B08B 9/45; B08B 9/47
(52) U.S. Cl. ..... 15/406; 15/304
(58) Field of Search ..... 15/304, 406, 408

(56) References Cited

U.S. PATENT DOCUMENTS

| | | | | |
|---|---|---|---|---|
| 1,007,888 A | | 11/1911 | Parker | |
| 1,538,698 A | | 5/1925 | Hall | |
| 1,580,294 A | | 4/1926 | Gawley | |
| 1,714,287 A | | 5/1929 | Wilson | |
| 1,929,387 A | | 10/1933 | Montgomery | |
| 2,078,634 A | * | 4/1937 | Karlstrom | 15/385 |
| 2,251,739 A | | 8/1941 | Huntsinger | |
| 2,735,122 A | | 2/1956 | Pletcher | |
| 2,917,762 A | | 12/1959 | Xenis | |
| 3,004,278 A | * | 10/1961 | Stanley | 15/319 |
| 4,268,769 A | | 5/1981 | Dorner et al. | 310/67 R |
| 4,384,386 A | | 5/1983 | Dorner et al. | 15/377 |
| 4,473,921 A | * | 10/1984 | Weber et al. | 15/304 |
| 4,535,196 A | | 8/1985 | Milne | 174/83 |
| 4,538,322 A | | 9/1985 | Ahlf et al. | 15/387 |
| 4,546,519 A | | 10/1985 | Pembroke | 15/395 |
| 4,589,161 A | | 5/1986 | Kochte et al. | 15/372 |
| 4,792,363 A | | 12/1988 | Franklin, Jr. et al. | 134/8 |
| 4,800,612 A | | 1/1989 | Valentine | 15/314 |
| 4,930,240 A | | 6/1990 | Bice | 42/95 |
| 4,984,329 A | | 1/1991 | Wade | 15/387 |
| 5,044,034 A | | 9/1991 | Iannucci | 15/1.7 |
| 5,074,007 A | | 12/1991 | Mai et al. | 15/344 |
| 5,088,149 A | | 2/1992 | Berg et al. | 15/322 |
| 5,107,568 A | | 4/1992 | Wade | 15/387 |

(List continued on next page.)

FOREIGN PATENT DOCUMENTS

| | | | |
|---|---|---|---|
| DE | 2064410 | 7/1971 | F23J/3/02 |
| EP | 550598 | 3/1996 | B08B/9/04 |
| GB | 456984 | 11/1936 | |
| GB | 1062393 | 3/1967 | |
| GB | 1074900 | 7/1967 | |
| SE | 500 428 | 6/1994 | B08B/9/04 |
| SE | 500 894 | 9/1994 | B08B/9/04 |
| SU | 500 428 | 1/1976 | |
| WO | WO 92/05888 | 4/1992 | B08B/9/04 |

OTHER PUBLICATIONS

Rotobrush® Website, Breathe Easy, Inc., *Legal Documents*, printed Jan. 11, 2002, 5 pgs.
Website for Central Vac International, *Power Brushes*, printed Jan. 28, 2002, 3 pgs.
Website for Janex Products, Authorized Rotobrush® Distributor, printed Jan. 11, 2002, 2 pgs., Copyright 1997–2000.
Website for Janex Products, Authorized Rotobrush® Distributor, *Air Duct Cleaning Equimpment*, printed Jan. 11, 2002, 2 pgs., Copyright 1997–2000.

(List continued on next page.)

*Primary Examiner*—Terrence R. Till
(74) *Attorney, Agent, or Firm*—Workman Nydegger

(57) ABSTRACT

A vacuum nozzle assembly is configured to couple to a vacuum hose of a vacuum assembly. The vacuum nozzle assembly includes (i) a cleaning member, (ii) a motor assembly configured such that actuation of the motor assembly causes the cleaning member to move; and (iii) a nozzle having a cylindrical wall. The nozzle couples to the motor assembly and a hose of a vacuum assembly. The nozzle has at least one opening through the wall thereof such that particles contacted by the cleaning member can be suctioned into a hose of a vacuum assembly. The motor of the motor assembly may be a bidirectional motor, for example.

35 Claims, 10 Drawing Sheets

U.S. PATENT DOCUMENTS

| | | | | | |
|---|---|---|---|---|---|
| 5,109,567 | A | | 5/1992 | Harrison | 15/345 |
| 5,167,047 | A | | 12/1992 | Plumley | 16/2 |
| 5,293,665 | A | | 3/1994 | Wörwag | 15/387 |
| 5,383,975 | A | | 1/1995 | Faxon | 134/22.11 |
| 5,428,862 | A | * | 7/1995 | Sailer | 15/321 |
| 5,584,093 | A | | 12/1996 | Melendres | 15/304 |
| 5,608,941 | A | | 3/1997 | Kleinfeld | 15/179 |
| 5,701,633 | A | | 12/1997 | Jonischus | 15/387 |
| 5,735,016 | A | * | 4/1998 | Allen et al. | 15/304 |
| 5,806,140 | A | | 9/1998 | Carlson et al. | 16/2.1 |
| 5,813,089 | A | | 9/1998 | Nolan et al. | 15/383 |
| 5,862,568 | A | | 1/1999 | Sjöberg | 15/304 |
| 5,893,194 | A | | 4/1999 | Karmel | 15/314 |
| 5,950,275 | A | | 9/1999 | Wörwag | 15/387 |
| 6,014,790 | A | | 1/2000 | Smith et al. | 15/304 |
| 6,032,325 | A | | 3/2000 | Smith | 15/304 |
| 6,058,547 | A | | 5/2000 | Foster | 15/104.12 |
| 6,061,860 | A | | 5/2000 | Fitzgerald | 15/1.7 |
| 6,199,237 | B1 | | 3/2001 | Budden | 15/1.7 |
| 6,209,169 | B1 | | 4/2001 | Dilger et al. | 15/387 |
| 6,269,519 | B1 | * | 8/2001 | Harvey et al. | 15/387 |
| 6,279,197 | B1 | | 8/2001 | Crutcher et al. | 15/383 |
| 6,686,950 | B1 | * | 2/2004 | Caffon et al. | 348/83 |

OTHER PUBLICATIONS

Website for KK Kleen Kuip Supply Mart Inc., *Rotobrush*, printed Jan. 11, 2002, 4 pgs., Copyright 2000.

Website for CM Cleaning Management, *Rotobrush* (*Breath Easy, Inc.*), printed Jan. 11, 2002, 2 pgs.

Rotobrush® Website, Breathe Easy, Inc., *Press Release, Jul. 2001*, printed Jan. 11, 2002, 2 pgs., Copyright 2000.

Rotobrush® Website, "*Rotobrush® Air Duct Cleaning Machine*", printed Jan. 11, 2002, 1 pg., Copyright 2000.

A–Town Hi Tech Website, 1 pg., printed Jan. 11, 2002, Copyright 2000.

* cited by examiner

VACUUM NOZZLE ASSEMBLY AND SYSTEM

THE FIELD OF THE INVENTION

This invention is in the field of devices for cleaning enclosed spaces such as ducts, pipes, and chimneys.

BACKGROUND

The cleaning of enclosed spaces within homes and in industrial settings has been an important service for many years. The cleaning of pipes, ducts and chimneys has created an industry of chimney sweeps, duct cleaners, and pipe cleaners who employ brushes attached to elongate structures that are extended along the lengths of these enclosed spaces to thereby clean the inner surfaces of the spaces.

Ducts within a home or other setting typically receive air from a forced air source. The forced air is often filtered, but can nevertheless contain contaminants that are blown into the ventilation ducts. Thus, these ducts require regular cleaning.

Furthermore, the outlets of such ducts that are located within various rooms often allow particles to be inserted within and remain within the duct system. Although outlets typically have some type of vent cover, such vent covers can, nevertheless, allow particles such as: (i) hair follicles, (ii) skin particles, (iii) dust particles, and (iv) small objects (e.g., insects) to infiltrate the duct system.

Once such particles are lodged into a duct system, it is possible for the particles to be forced back from the duct system into the living space of a home, office, or building when the ventilation system is actuated.

A variety of different cleaning systems have been employed to clean such enclosed spaces. For example, one typical system employs a vacuum hose communicating with a vacuum source. At one end of the vacuum hose is a nozzle having a rotating brush thereon. Extending through the vacuum hose is a flexible metal shaft that rotates the brush. A motor turns the metal shaft. When the motor and vacuum source are actuated, the brush turns and dust and other particles are suctioned through the nozzle into the vacuum hose. The turning of the brush dislodges particles from within an enclosed space, while the suctioning of the hose removes the particles from the space.

Such typical designed systems have various drawbacks. For example, the flexible metal shaft typically rotates within a plastic vacuum hose. As the vacuum hose is inserted within an enclosed space, the metal shaft can contact the hose while the shaft is rotating. In addition, the force created by the motor to drive the shaft is required to extend along the length of the vacuum hose to the rotating brush, stressing the drive motor. The flexible metal shaft can also add weight and inflexibility to the hose.

Furthermore, the rotating shaft can typically be viewed through holes in the nozzle. The nozzle holes are designed to allow particles through the holes and into the vacuum hose. However, it is possible that hair, string, fingers, or other objects can be fed within the holes and contacted by high speed rotating shaft. A typical version of such a rotating shaft and nozzle combination features longitudinal safety bars extending across the holes, but a small finger or hair can nevertheless be extended through the holes past the bars and contact the rotating shaft, possibly winding around the rotating shaft.

Another problem within the art is that vacuum assemblies employed for pipe and duct cleaning tend to be large and bulky, requiring that a bulky vacuum source be brought within an individual's home or other building and dragged behind a vacuum hose in order to perform the desired cleaning.

What is therefore needed is an improved device for cleaning within an enclosed space, such as a duct, pipe or chimney.

BRIEF SUMMARY OF THE INVENTION

A vacuum system of the present invention comprises a vacuum source and a motorized vacuum nozzle assembly communicating with the vacuum source. The nozzle assembly can communicate directly through a hose with the vacuum source or communicate with the vacuum source through the use of a portable transfer station communicating with the vacuum source.

The vacuum nozzle assembly is configured to be placed within an enclosed space such as a duct, pipe, or chimney and to brush particles within the enclosed space and allow the particles to be suctioned through the vacuum nozzle assembly and into the transfer station or directly to the vacuum source. A duct or other space to be cleaned may be rectangular, circular, flexible, irregular shaped and/or insulated, for example.

The transfer station has ports therein which allow the particles to be suctioned from the vacuum nozzle assembly, through the transfer station and into the vacuum source. The vacuum source may be located within a separate component from the transfer station such as within a vehicle parked outside of the home or building that is being cleaned. Optionally, however, the vacuum source may be located within the transfer station. In another embodiment, the nozzle assembly communicates through a hose with a vacuum source located within a vehicle, such as a truck or van parked outside the home or other building.

The vacuum nozzle assembly comprises a hollow vacuum nozzle having a proximal end, a distal end, and a cylindrical wall extending between the proximal and distal ends. At least one opening extends through the wall to allow particles to be suctioned through the wall and into the vacuum source. Preferably, a plurality (e.g., 3) of openings extend through the wall.

A motor assembly is coupled to the distal end of the nozzle and a cleaning brush is moved (e.g., rotated) by the motor assembly. Thus, upon actuation of the motor assembly and the vacuum source, particles contacted by the cleaning brush are suctioned through at least one opening of the nozzle, through a vacuum hose and through the transfer station or directly through a hose to the vacuum source.

In one embodiment, the cylindrical wall of the nozzle has an inner annular wall extending inwardly therefrom that substantially encapsulates the proximal end of the motor. The inner wall may extend integrally from the cylindrical wall, for example. In one embodiment, the cylindrical nozzle wall and/or inner annular wall comprise a plastic material.

As a major advantage of the present invention, since the vacuum source may be located in a vehicle such as a van or truck outside the home or building being cleaned, the nozzle assembly can be readily moved throughout the home of an individual, optionally employing a transfer station. This is an improvement over previous designs in which a large vacuum assembly is required to be moved within an individual's home or building.

As another major advantage of the invented system, the motorized vacuum nozzle assembly can readily move around corners within enclosed spaces and does not risk damaging the vacuum hose by a rotating shaft because there is no rotating shaft in the hose. Since the motor assembly is coupled to the nozzle, the motor assembly and cleaning member can be readily directed by directing the nozzle assembly left or right. Furthermore, the present design prevents particles from being lodged in between the nozzle opening(s) and the drive shaft, making the design safer.

Another advantage is the use of large holes, e.g., wide, laterally oriented holes that enable larger particulate to be suctioned through the nozzle. This is permissible in part because there is no rotating shaft extending along the nozzle and hose. In one embodiment, the width of the holes is substantially greater than the length of the holes. In this embodiment, the amount of hole space can be maxmized while still minimizing the length of the nozzle, thereby increasing the ability of the nozzle assembly to turn comers within enclosed spaces, such as ducts.

In one embodiment, the motor assembly is bi-directional, such that the drive shaft of the motor assembly (and consequently the cleaning member coupled thereto) can rotate left or right. This has many advantages, such as enabling the user to direct the cleaning member to take a right turn or left turn within a duct system, and/or to clean the right or left side of a duct.

Furthermore, according to one cleaning method, a brush or other cleaning member is actuated to rotate to the right upon entering a rectangular cross sectionally shaped duct, thereby cleaning the right hand side, then is actuated to rotate to the left, thereby rolling over to the left hand side and cleaning the left hand side of the duct as the brush is pulled outwardly.

These and other objects and features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1:
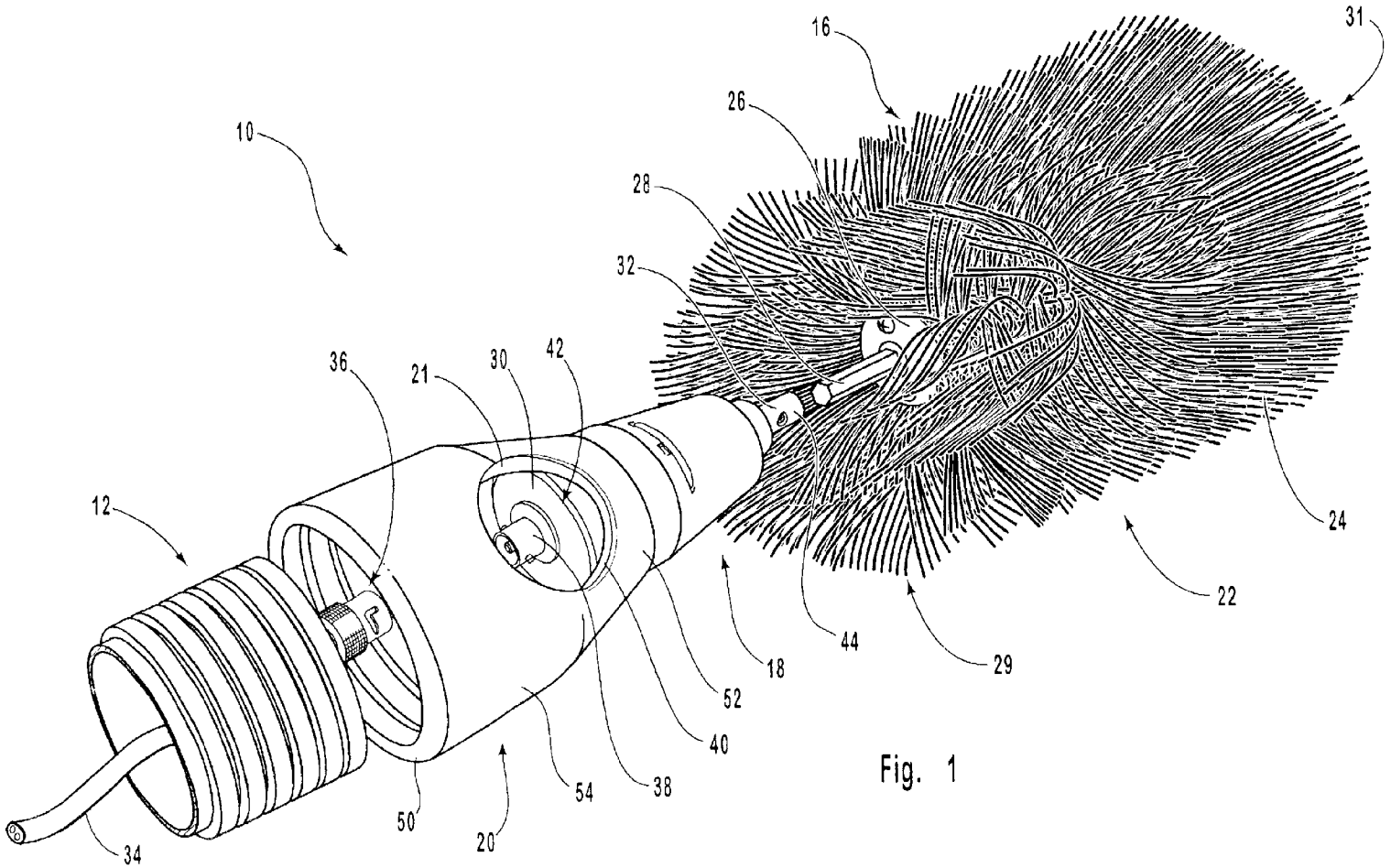
FIG. 1 is an exploded view of a motorized vacuum nozzle assembly of the present invention.
Figure 2:
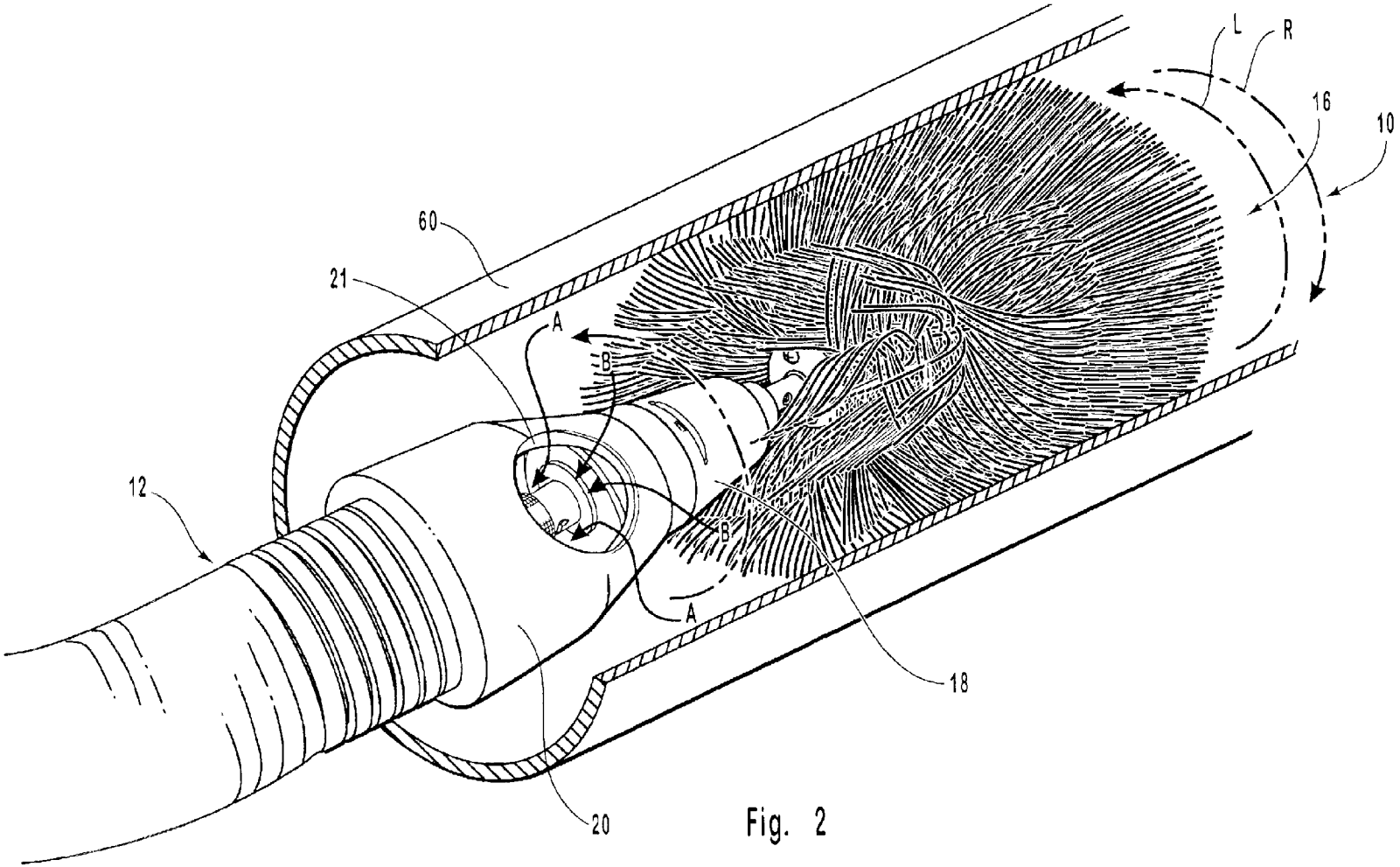
FIG. 2 is a view of an assembled assembly of FIG. 1 within an enclosed space such as a pipe.
Figure 3:
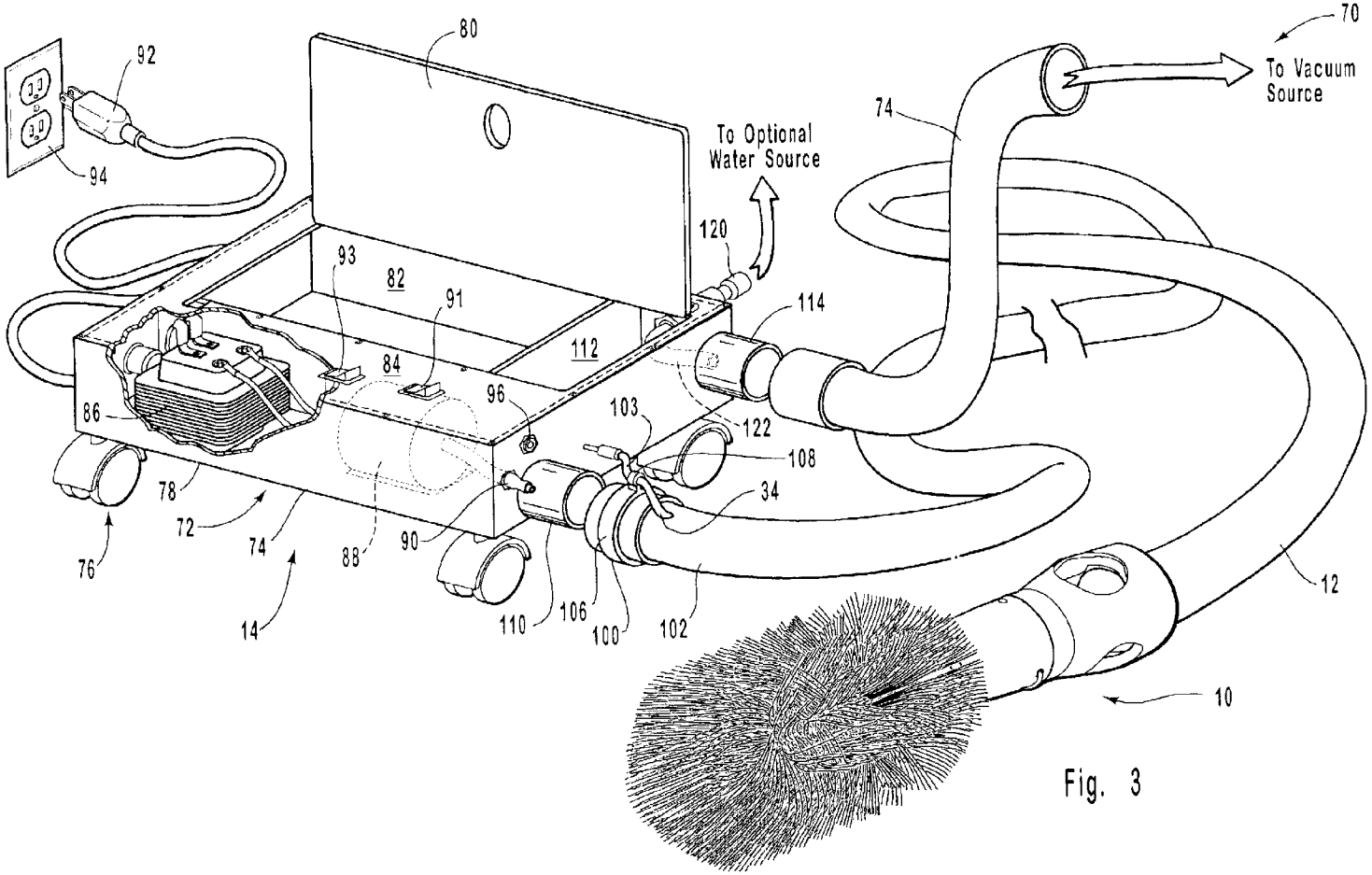
FIG. 3 is a view of a vacuum assembly having the motorized vacuum nozzle assembly of FIG. 1 and having a transfer station and a vacuum source, with portions thereof shown in phantom lines and cutaway views.

With reference to FIGS. 1–4, a motorized vacuum nozzle assembly 10 is shown. Nozzle assembly 10 is configured to couple to a flexible vacuum hose 12 of a vacuum assembly 14 (FIG. 3).

Nozzle assembly 10 is shown in an exploded view in FIG. 1. Assembly 10 comprises: (i) a movable cleaning member 16 that contacts particles within an enclosed space; (ii) a motor assembly 18 configured to move the cleaning member, and (iii) a nozzle 20 configured to couple the motor assembly 18 to a hose 12 of a vacuum assembly (e.g. assembly 14). Nozzle 20 has at least one opening 21 therethrough, such that particles contacted by the cleaning member 16 can be suctioned through the at least one opening 21 and into hose 12.

Each of these components will now be discussed in additional detail. Cleaning member 16 comprises a brush comprising: (i) a plurality of bristles 24, (ii) a brush head 26 upon which the bristles are mounted, and (iii) a post 28 extending from the brush head 26 and coupling to motor assembly 18. Cleaning member 16 may have a variety of different configurations, any of which may be employed to contact the interior surface of enclosed space such as a cleaning duct or pipe.

In one embodiment, motor assembly 18 comprises (i) a motor 30 (e.g., an electrical motor) and (ii) a drive shaft 32 which selectively receives the post 28 of cleaning member 16 therein, thereby conveniently, selectively coupling to the cleaning member 16. In one embodiment, motor assembly 18 further comprises a clutch and a transmission such that in the event the brush becomes stuck within the enclosed space, the clutch disengages, and such that the motor assembly 18 does not burn out or continue to turn the brush 16. The motor assembly of the present invention may be bi-directional.

Motor assembly 18 receives power from a power source, such as (i) an electrical cord 34 configured to extend through hose 12 and electrically couple to an outlet; or (ii) a battery, for example. Electrical cord 34 selectively couples to the motor 30 through the use of an interlocking connection, such as an electrical plug 36 that selectively couples to receptacle 38 on motor 30. In another embodiment, however, an electrical cord is permanently coupled to the motor 30. Thus, the motor assembly can be battery operated or operated through the use of an electrical cord.

Thus, in one embodiment, the motor assembly 18 comprises a motor, transmission, clutch and drive shaft. For example, in one embodiment, the motor assembly comprises a motor assembly from a motorized drill-driver, such as a RYOBI handheld drill-driver, available from Ryobi Technologies, Inc., 1428 Pearman Dairy Road, P.O Box 1207, Anderson, S.C., 29622-1207, U.S.A. In one embodiment the motor assembly comprises a battery operated, cordless drill-driver, such as a 12 Volt drill-driver.

Motor assembly 18 has a proximal end 42 and a distal end 44, which in FIG. 1 includes the drive shaft 32. As shown, the distal end 44 of motor assembly 18 is coupled to the proximal end 29 of the cleaning member such that the distal end 31 of the cleaning member can be forced within an enclosed space. Thus, actuation of motor assembly 18 causes cleaning member 16 to remove particles from surfaces contacted by cleaning member 16.

Nozzle 20 has a proximal end 50 having a proximal opening therein and a distal end 52 having a distal opening therein, distal end 52 being coupled to motor assembly 18. Distal end 52 may be coupled to motor assembly 18 through the use of screws, rivets, and/or an adhesive, for example. Nozzle 20 further has a cylindrical wall 54 extending between proximal end 50 and distal end 52. In the assembled embodiment shown (FIG. 2), a portion of motor assembly 18 is positioned within the opening in the distal end 52 of the nozzle 20 and a portion of hose 12 is positioned within the proximal opening within proximal end 50 of nozzle 20. Thus, proximal end 50 of nozzle couples to hose 12. The interior surface of proximal end 50 of nozzle may be threaded, as shown, so as to threadedly couple to a threaded vacuum hose 12, also shown in FIGS. 1–2. Nozzle 20 may have internal or external threads at a proximal end thereof for threadably coupling to a hose 12.

As mentioned, nozzle 20 has at least one opening 21 through the wall 54 thereof, such that particles contacted by the cleaning member can be suctioned through the at least one opening 21 and into the hose of the vacuum assembly. Each opening 21 is defined by a rim 40. It will be appreciated that a variety of different openings may be employed such as two, three, four or more openings. In one embodiment, three openings are employed and the three openings are symmetrically spaced within the wall 54 of nozzle 20.

Thus, assembly 10 is configured to couple to vacuum hose 12 and has a moveable cleaning member 16 that contacts particles within an enclosed space, and at least one opening 21 through which particles are suctioned out of the enclosed space. Nozzle 20 is an example of means for coupling motor assembly 18 to hose 12.

While a brush is shown in FIG. 1 as cleaning member 16, other examples of cleaning members that may be employed include chiseling members, scraping members, or various members having roughened surfaces or any surface which allows particles to be contacted and when contacted are removed from within the wall of an enclosed space. Thus, a brush is only one embodiment of a cleaning member of the present invention.

With reference now to FIG. 2, assembly 10 is shown within an enclosed space, such as a pipe 60 with the hose threaded in the proximal end of the nozzle. Upon actuation of motor assembly 18 and a vacuum source, cleaning member 16 is rotated at high speed and particles contacted by cleaning member 16 are suctioned through opening 21 as shown by the arrows A and B.

In one embodiment, these particles continue through a transfer station and into the vacuum sources, as will be discussed in additional detail. Optionally, however, hose 12 communicates directly with a vacuum source without extending through a transfer station.

Since motor assembly 18 is coupled to nozzle 20, the motor assembly 18 can be directed to a variety of different desired positions within the enclosed space. Since the vacuum nozzle assembly is a motorized vacuum nozzle assembly, the vacuum nozzle assembly is portable and can be moved into a variety of different spaces, is safe, and has many other advantages. Although a pipe 60 is shown as an enclosed space, it will be appreciated that other examples of enclosed spaces include ducts, other ventilation system components, chimneys, or any other enclosed space in which it is desirable to have a moving cleaning member and a vacuum source associated therewith. Nevertheless, while assembly 10 can be used within an enclosed space, it will also be appreciated that assembly 10 can also be employed within a nonenclosed, i.e. open space to clean selected surfaces.

Also as illustrated in FIG. 2, in one embodiment, the motor assembly is bi-directional, such that the motor assembly can rotate the cleaning member left "L" or right ("R"). The bidirectional nature of the motor assembly enables the drive shaft of the motor assembly to selectively move in a right hand "R" (i.e., clockwise) direction or a left hand "L" (i.e., counterclockwise direction) depending upon the direction desired by a user. The user can thus rotate the brush or other cleaning member in a desired direction within an enclosed space.

For example, if the user desires the nozzle assembly to make a right turn within a duct system, the motor assembly can be directed to move the cleaning member in a right hand, i.e., clockwise direction, causing the cleaning member to move toward the right within the duct system. Optionally, the cleaning member can be directed to move to the left within the duct system by moving the cleaning member in a left hand turn. This has many advantages, particularly with ductwork, such as enabling the cleaning member to clean either the left or right side of a duct, as selected by a user, or to first clean one side (e.g., the right side by causing right hand rotation) as the user is moving the nozzle assembly into a duct, then clean another side (e.g., the left side by causing right hand rotation) as the user moves out of the duct.

As mentioned, in one embodiment, a motor assembly of the present invention is affixed to the nozzle through the use of screws that couple the motor assembly to the nozzle. The screws may be counter sunk into the nozzle, for example. Optionally, the nozzle may be coupled to the motor assembly through a variety of different methods, such as through the use of interlocking threads, adhesive, a tight fit, interlocking ridges and grooves, or a variety of other methods. Similarly, in one embodiment, the nozzle is affixed to the hose through the use of screws that couple the hose to the nozzle. These screws may also be counter sunk into the nozzle, for example.

With reference now to FIG. 3, vacuum assembly 14 will be discussed in additional detail. Vacuum assembly 14 comprises (i) nozzle assembly 10; and (ii) a vacuum source 70, such as a vacuum located within a vehicle, e.g., a truck or van, located outside a home or other building.

Vacuum assembly 14 further comprises a transfer station 72 communicating via flexible hose 74 with the vacuum source, and also communicating via hose 12 to the vacuum nozzle assembly 10. Thus, transfer station 72 communicates with vacuum source 70 and with motorized vacuum nozzle assembly 10.

Transfer station 72 comprises carriage 73 having a plurality of wheels 76 coupled thereto (e.g., four sets of castors on the underside corners of carriage 73). Carriage 73 comprises a carriage housing 78 and a door 80 hingedly coupled to housing 78, the housing 78 having a first compartment 82 within which tools or other components may be placed.

Housing 78 further has a second compartment 84 in which a transformer 86 may be mounted as well as a compression motor 88 for forced air, should the user desire to spray forced air into an enclosed space to help loosen particles such as dust. Forced air source 88 is coupled to a forced air port 90 to which an air hose can be attached. In one embodiment, the compression motor 88 is a high vibration supersonic air horn compressor, such as a two-trumpet air horn compressor that emits a sonic pulsating air. An on/off button 91 that actuates the forced air is shown over the air compressor 88. An on/off button 93 that controls the source of power to the motor assembly 18 may be similarly placed on housing 78 to thereby selectively actuate the motor assembly.

Transformer 86 receives power from electrical cord 92, which may couple to an outlet 94, such as a wall mounted outlet or another source of electrical power. Transformer 86 is also electrically coupled to an outlet 96 mounted on housing 78 to which electrical cord 34 may be selectively electrically coupled, thereby electrically coupling transformer 86, cord 92, and outlet 94 to cord 34.

Figure 4:
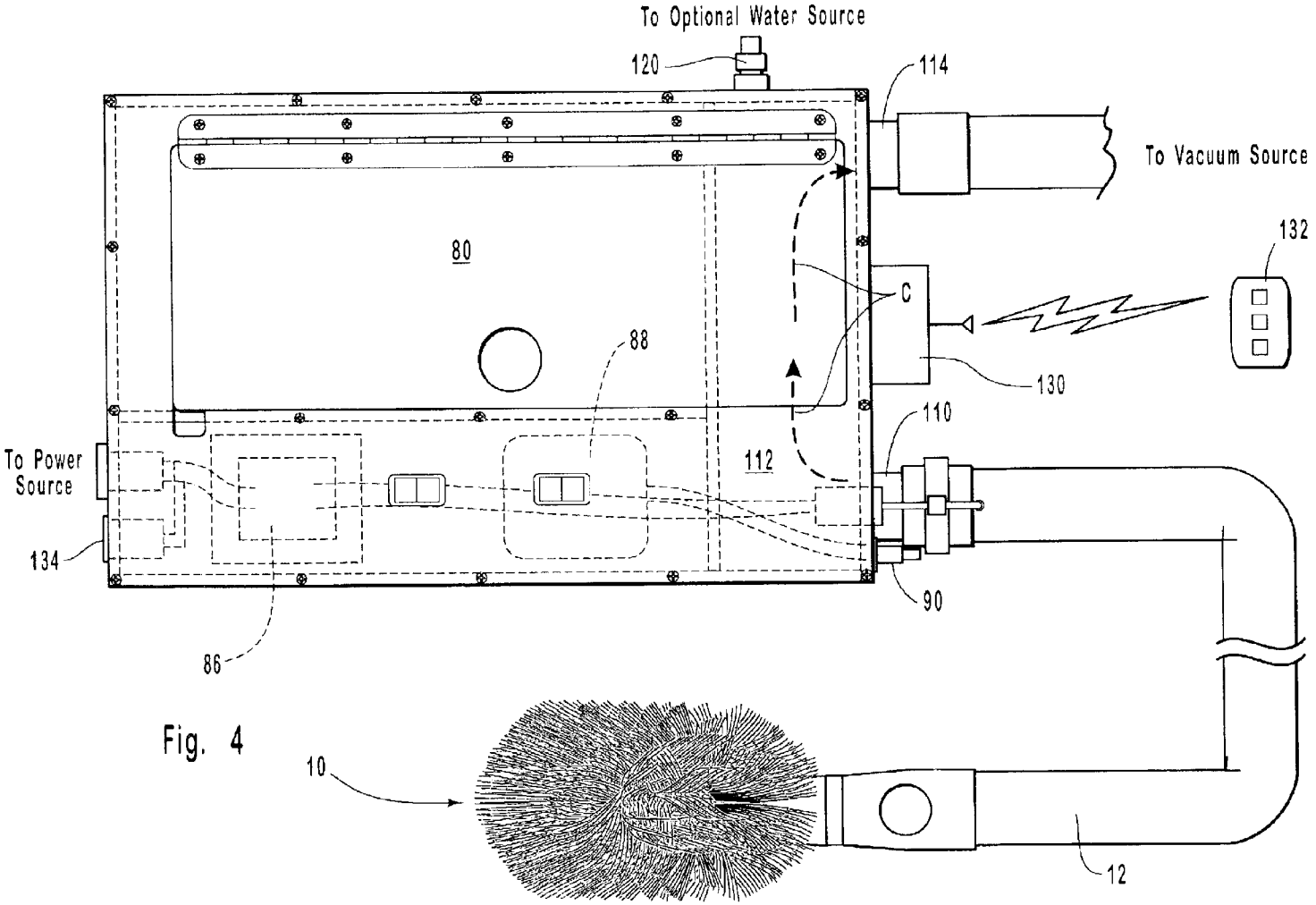
FIG. 4 is a top, schematic view of the assembly of FIG. 3, with portions thereof shown in phantom lines and with a remote control system added thereto for wireless control.

The transformer 86 in FIG. 4 may be employed to transform electrical power from a wall mounted electrical outlet to battery power, which may be used in the motor assembly 18. In one embodiment, the transformer comprises a transformer with a DC converter, so as to transform AC power (e.g., 110 Volt AC) to 12 Volt DC, 18 Volt DC, 6 Volt DC or other DC power. The motor assembly may thus employ DC power, such as 12 Volt, 18 Volt, 6 Volt or other DC power. Optionally, however, the motor assembly employs AC power.

A collar 100 may be coupled to a proximal end 102 of hose 12 and a proximal end 103 of cord 34 to thereby retain a proximal end 103 of cord 34 in a desired position with respect to hose 12, the collar 100 having a first member 106, which couples to end 102 and a second member 108 which couples to end 103.

Proximal end 102 of hose 12 couples to a first vacuum port 110 on housing 78, through which vacuumed particles flow into a third compartment 112. The vacuumed particles then flow out of a second vacuum port 114 and into hose 74 connected to vacuum source 70. Since each of the ports 110 and 114 are in fluid communication with compartment 112, the particles flow from hose 12, through port 110, into compartment 112, and through port 114 into hose 74, as further shown by arrows "C" in FIG. 4. As shown, compartment 112 allows dust to extend in the path of arrow C from port 110 to port 114.

A third port 120 is coupled to housing 78 to thereby allow a fluid such as water to be sprayed into port 114 (and/or compartment 112), such that particles can be dampened as they flow into hose 74 and into the vacuum source. The port 120 may include a water jet that mistifies water and breaks down dust such that it collects as a slurry within the bottom of the vacuum collection tank (e.g., within a truck or van outside a home or other building) rather than collecting as dust in the filter of the vacuum source. A water hose couples to port 120. Third port 120 may be in fluid communication with compartment 112 and/or second port 114 such that a fluid can move through the third port into the stream of particulate flow.

Optionally, the water source is coupled to the vacuum source collection tank to break down dust at the tank. In such an optional embodiment, a water hose is not brought into the home or otherwise couple to the transfer station.

The transfer station 72 enables a user to move a small carriage about a home or other building with the vacuum source located in a vehicle outside the building. This is convenient for the cleaner, particularly when rounding corners and extending into awkward spaces. Furthermore, tools may be placed within the transfer station. In addition, a fiberoptic video camera (allowing detailed inspected of the enclosed spaces) and/or related components may be mounted within or on the transfer station and/or receive power therefrom.

FIG. 4 also illustrates a remote control system that may be employed to remotely control the actuation and/or direction of rotation of the motor assembly 18. FIG. 4 illustrates a transmitter 132 and a receiver 130 that is electrically coupled to motor assembly 18. The remote control system may have an on/off feature that turns the motor assembly 18 and/or vacuum source on and off. The remote control system may also selectively actuate the motor assembly 18 to rotate the drive shaft thereof in a left or right direction, for example, as desired by the user.

In one embodiment, transfer station further includes an override system that manually overrides the remote control capability. For example, on/off button 93 that selectively actuates motor assembly 18 may be configured to override the remote control system.

Also as shown in FIG. 4, transfer station 14 may comprise an external electrical outlet 134 that is electrically coupled to electrical cord 94 and/or transformer 86 to thereby allow additional components, e.g., a camera, light, or other component to be powered by plugging into the transfer station's electrical power system.

In yet another embodiment, however, rather than employing a transfer station, the hose 12 plugs directly to a vacuum assembly mounted within a vehicle. For example, in one embodiment, a transformer electrically coupled to motor assembly 18 is mounted on or within the hose 12 with an electrical cord extending from the transformer such that the electrical cord can be electrically coupled to a power source (e.g., a 12 Volt power source) in or on the vehicle. In another embodiment, a transformer is located within the vehicle, rather than on or within the hose, to which the motor assembly 18 is electrically coupled.

Figure 5:
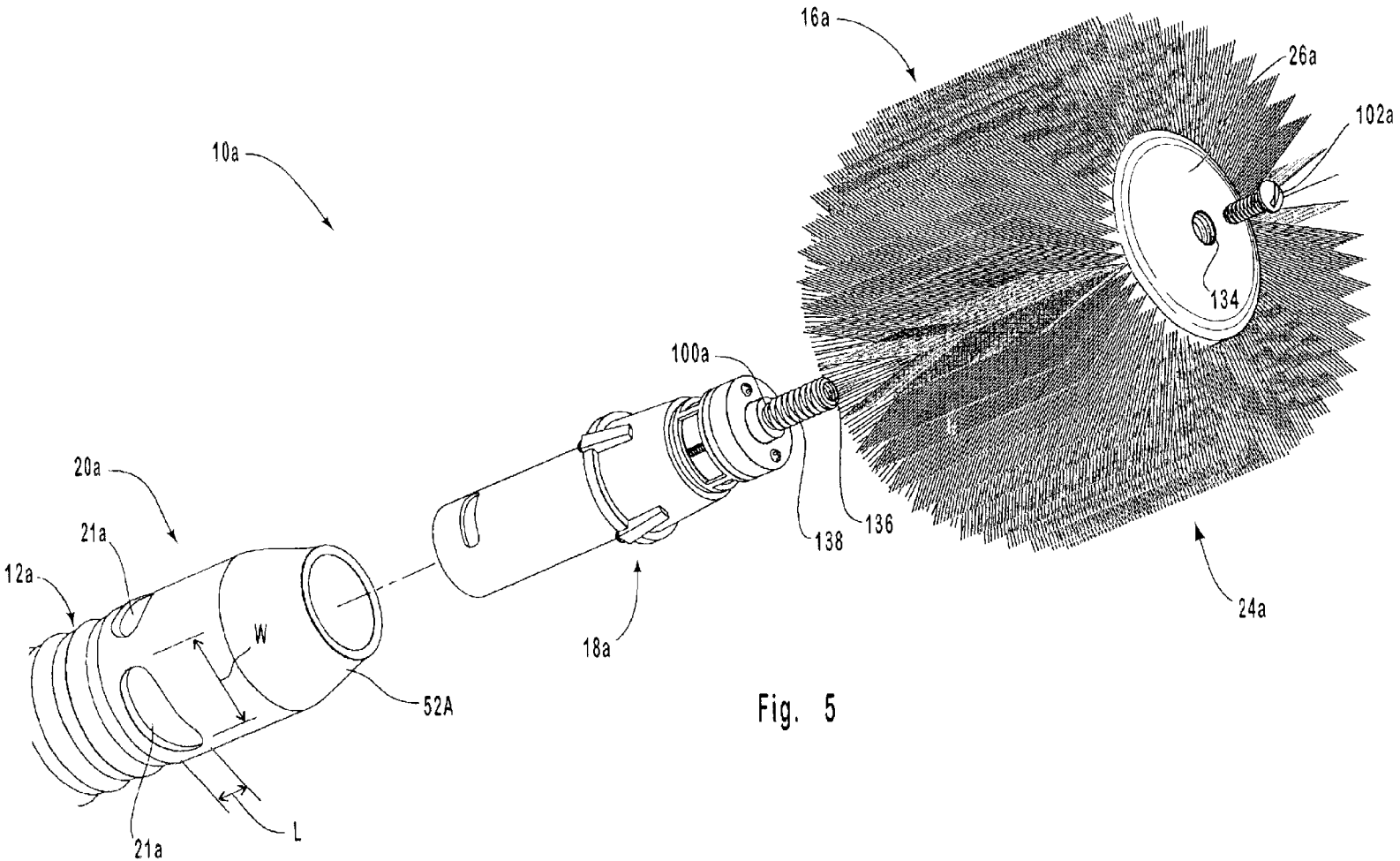
FIG. 5 is an exploded view of another motorized vacuum nozzle assembly of the present invention.

FIGS. 5–8 show additional embodiments of a motor assembly and cleaning member of the present invention. Thus, another embodiment of a motorized vacuum nozzle assembly 10*a* is shown in FIG. 5. Assembly 10*a* comprises (i) a cleaning member 16*a* in the form of a brush, (ii) a motor assembly 18*a* comprising a motor, clutch and transmission, and (iii) a nozzle 20*a* shown as being coupled to a hose 12*a*. In one embodiment, the clutch of the motor assembly is a breakaway clutch. One advantage of employing a motor assembly having a motor, transmission and clutch is that upon contacting a location in which the cleaning member does not move, the clutch can prevent continued movement of the cleaning member, thereby preventing the motor assembly 18*a* from burning out. A threaded drive shaft 100*a* may extend from the clutch of the motor assembly 18, for example.

Figure 6:
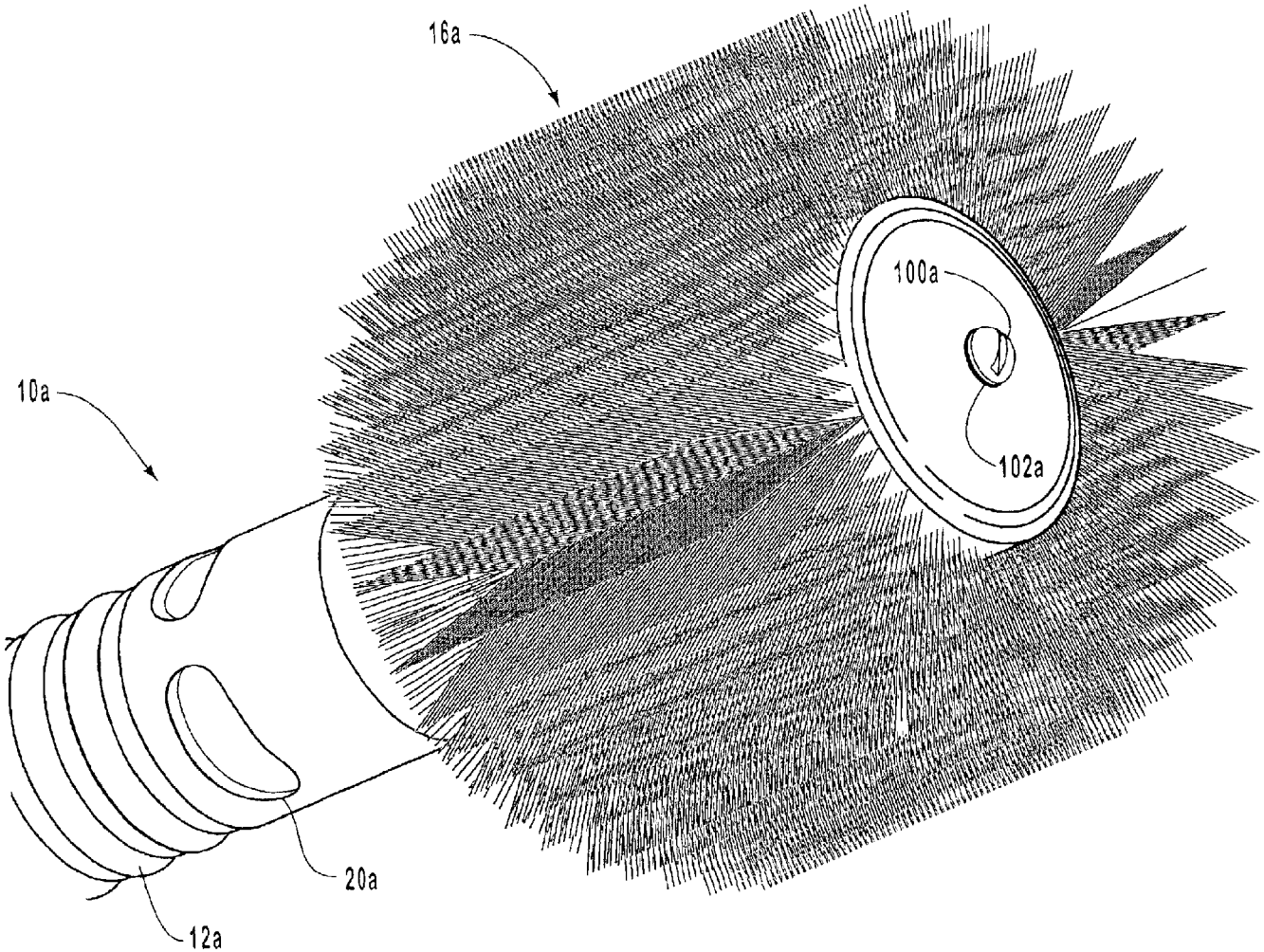
FIG. 6 is an assembled view of the assembly of FIG. 5.

An assembled view of assembly 10*a* is shown in FIG. 6. Also as shown in FIG. 5, nozzle 20*a* has a variety of different openings 21, namely three openings 21*a*, each of which can receive dust or other particles therethrough. As shown in the embodiment of FIG. 5, in one embodiment, the width "W" of the holes is substantially greater than the length "L" of the holes, such that the holes can be large without taking up a great deal of space along the longitudinal axis of the nozzle, and thereby decreasing the length of the overall nozzle without sacrificing hole size.

Figure 7:
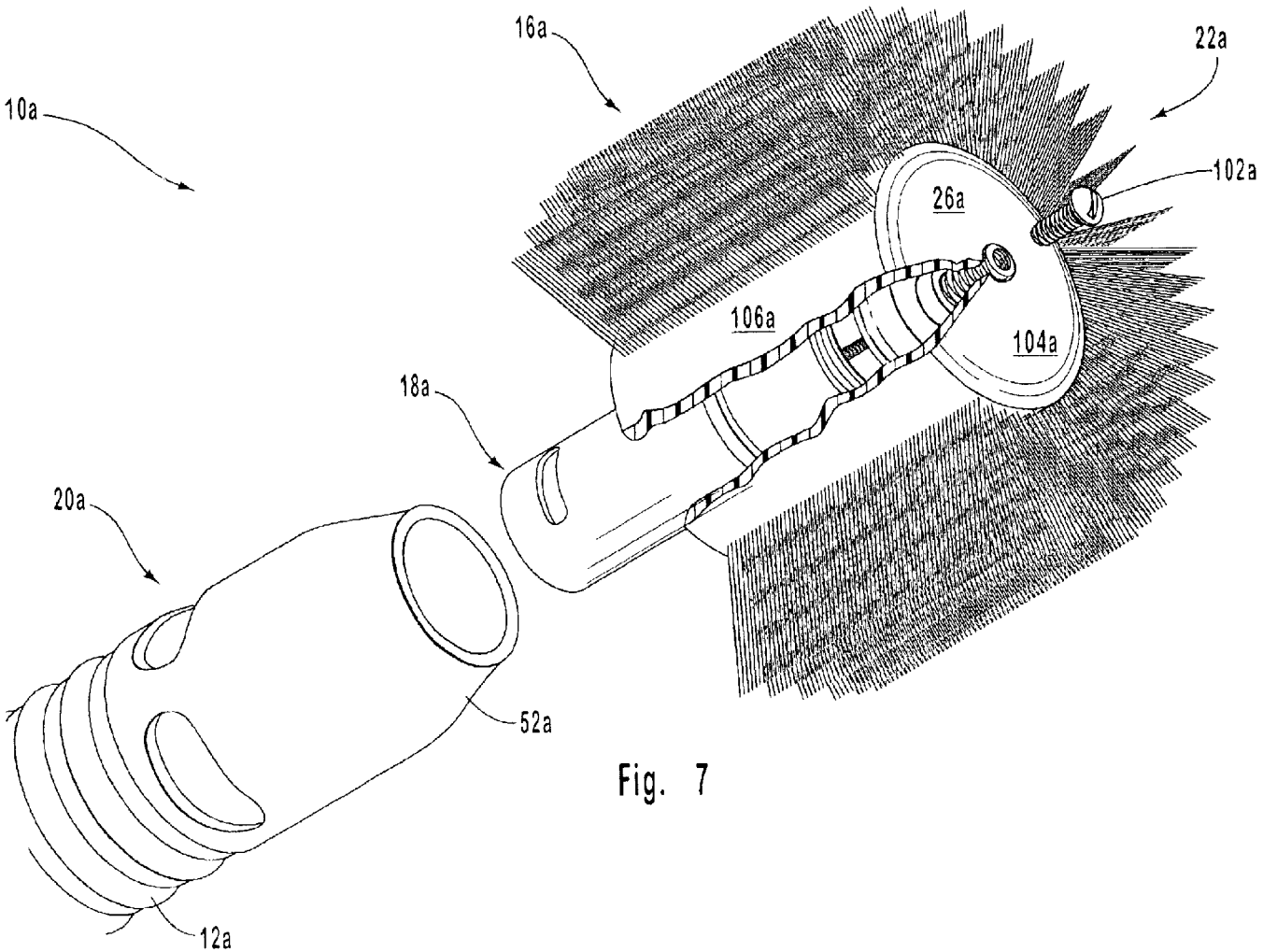
FIG. 7 is a view of the assembly of FIG. 5 with a brush head shown in a cutaway view and with the motor assembly being exploded from the nozzle.

In the embodiment of FIGS. 5 and 6, and as further shown in FIG. 7, cleaning member 16*a* comprises a brush 16*a*, comprising a plurality of bristles 24*a*, coupled to a brush head 26*a*. FIG. 7 shows a surface of brush head 26*a* in which certain bristles have been removed for illustration purposes and in which a portion of the brush head is cutaway also for illustration purposes. As shown in this embodiment, brush head 26*a* comprises a hollow brush head having a distal end wall 104*a* and a cylindrical side wall 106*a* extending downwardly therefrom. Bristles may also be mounted on the exterior surface of the distal end wall 104*a* of the brush head.

The hollow head 26*a* of brush 16*a* is configured to be mounted upon and encapsulate at least a portion of motor assembly 18*a* as shown in FIG. 7. One advantage of this compact design is that motor assembly 18*a* can have a significant amount of componentry, such as the transmission and the clutch, and yet not take up a great deal of space within an enclosed space, such as a duct or pipe. Thus, the space is used efficiently. The space extending distally from nozzle 20*a* is shared by brush 16*a* and at least a portion of motor assembly 18*a*. As a result, the use of space at the distal end of nozzle, is highly efficient. The wide holes 21*a* are also highly efficient and can reduce overall nozzle length. The efficiencies are important for motor assembly 18*a* which must negotiate cramped, enclosed spaces and twisting angles.

Motor assembly 18*a* may comprise a threaded drive shaft 100*a*. Shaft 100*a* has external threads 138 that thread into internal threads 134 of the brush head of brush 16*a*. In one embodiment, such threading may be reverse threaded. To further insure the connection between brush 16*a* and motor assembly 18*a*, a screw 102*a* may be screwed into internal threads 136 within drive shaft 100*a*. As shown in FIG. 6, the head of screw 102*a* abuts the brush head end wall 104*a* to thereby assist in maintaining the brush 16*a* firmly on the motor assembly drive shaft 100*a*.

In one embodiment, the threads of screw 102*a* are left handed threads, that mate with left handed internal threads 136, while the internal threads 134 of the brush head are right handed internal threads that mate with right handed external threads 138 of shaft 100*a*.

Figure 8:
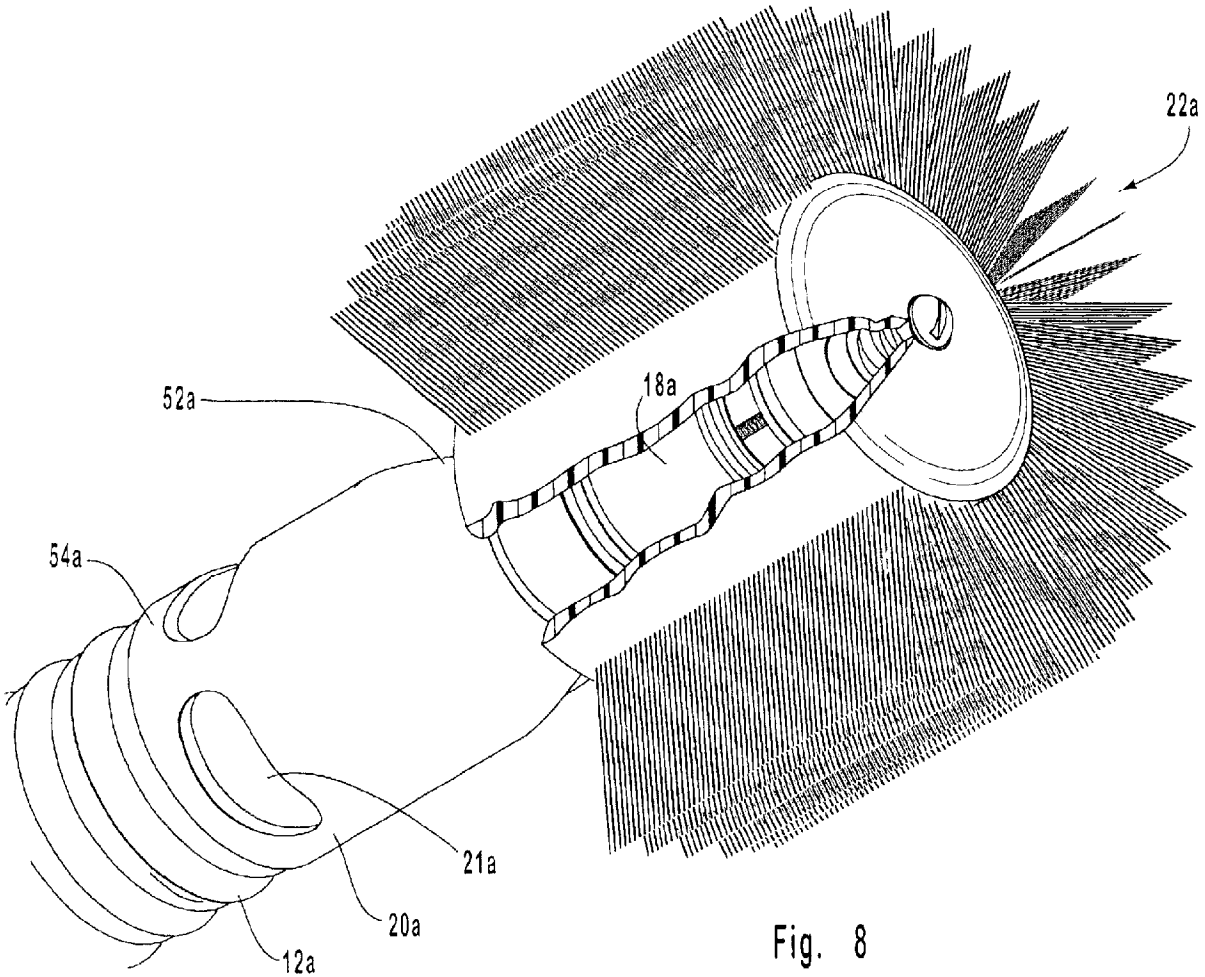
FIG. 8 is a view of the assembly and brush head of FIG. 7 with the assembly being mounted on the nozzle with the brush head being shown in a cutaway view.

FIG. 8 further shows (i) the mounting of brush 16*a* on top of motor assembly 18*a*, thereby encapsulating a portion of assembly 18*a* and optionally a portion of nozzle 20*a*, and (ii) the coupling of motor assembly 18*a* to nozzle 20*a*, such that space at the distal end of nozzle 20*a* is very efficiently used. Furthermore, by placing brush 16*a* about motor assembly 18*a*, brush 16*a* helps to stabilize the motor assembly within the nozzle 20*a* while the nozzle assembly 18*a* is within an enclosed space.

Figure 9:
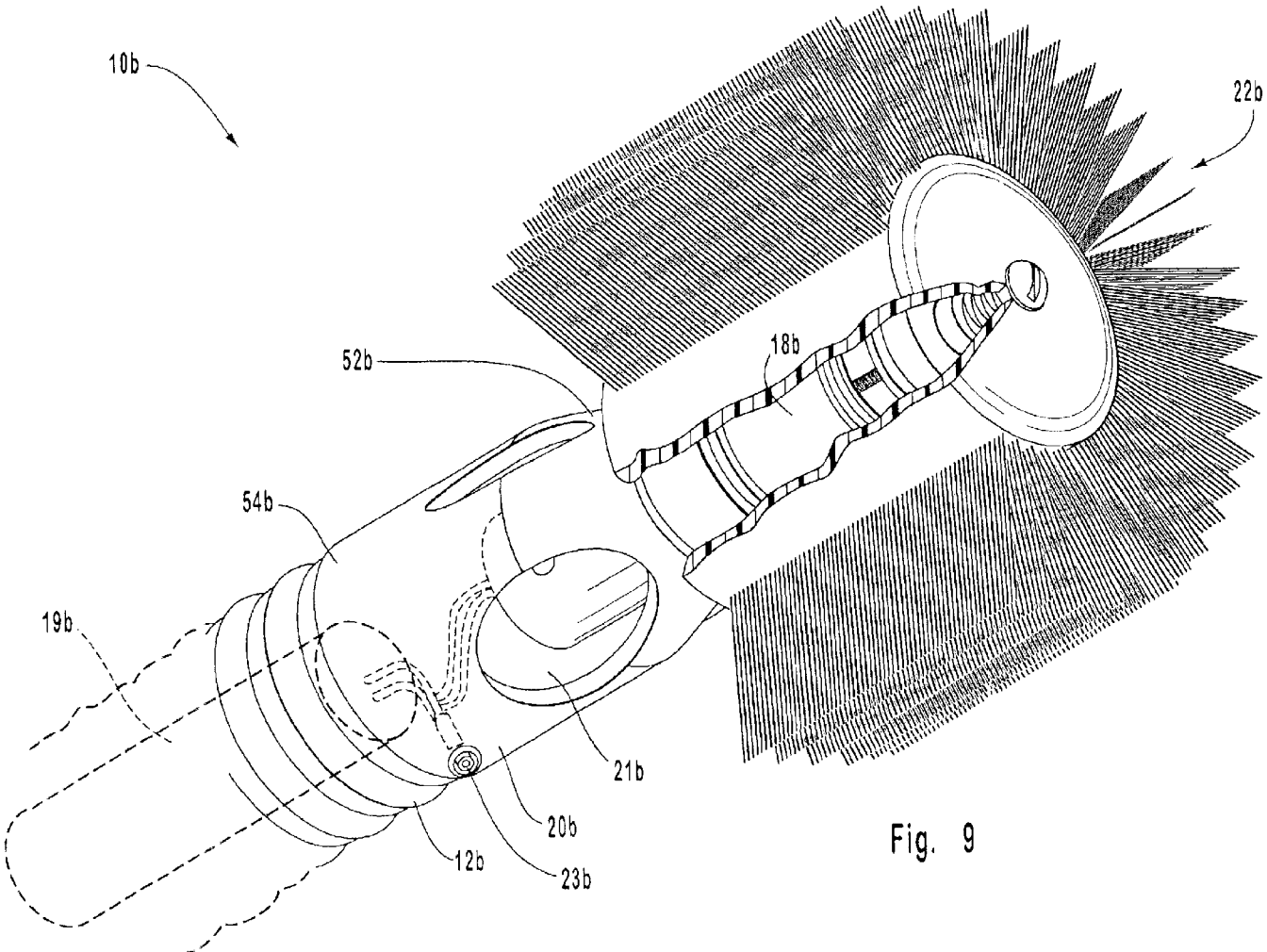
FIG. 9 is a view of an alternative motorized nozzle assembly of the present invention comprising a battery pack shown in phantom lines and electrically coupled to the motor of the present invention.

In yet another embodiment of an assembly 10*b*, as shown in FIG. 9, rather than employing an electrical cord, motor assembly 18*b* receives power from a battery pack 19*b*, which extends within nozzle 20*b* and possibly within hose 12*b* and comprises one or more batteries. Thus, the motor assembly is battery operated. Furthermore, a charger port 23*b* may be counter sunk within the nozzle 20*b* or otherwise mounted within nozzle 20*b* or hose 12*b*, such that the battery pack can be recharged. Optionally, a wire can extend from the hose or nozzle in order to charge the battery pack.

Figure 10:
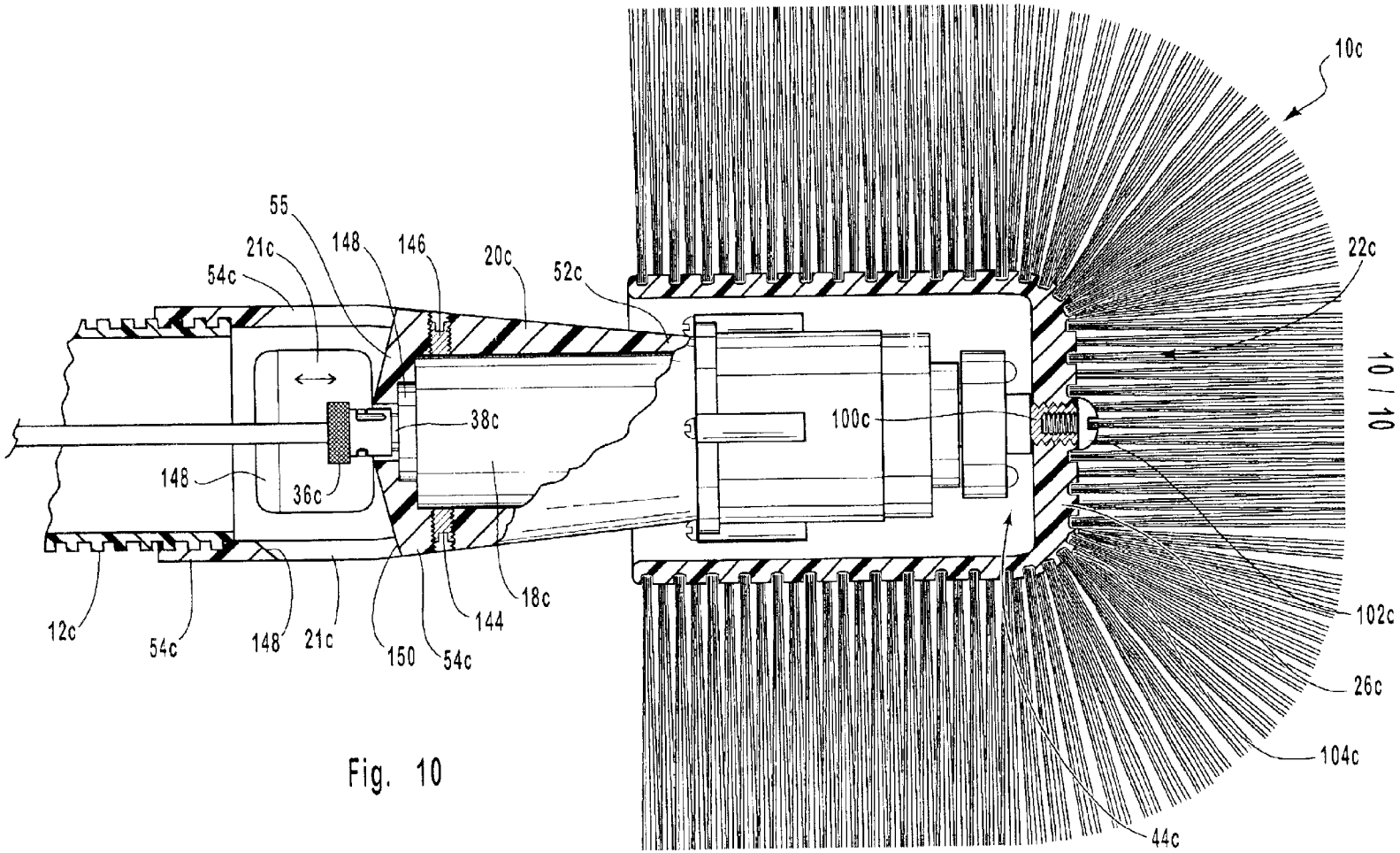
FIG. 10 is a partially cross sectional view of an alternative motorized nozzle assembly of the present invention having an inner annular wall 55 coupled to the cylindrical wall 54*c* of the nozzle.

Another embodiment of a nozzle assembly 10*c* is shown in FIG. 10. As shown, the motor assembly 18*c* is substantially enclosed within nozzle 20*c*. Also as shown in FIG. 10, the cylindrical outer wall 54*c* of the nozzle 20*c* has an inner annular wall 55 extending therefrom that substantially encapulsates the proximal end of the motor, yet allows an electrical connection to extend through wall 55. The inner wall 55 may be integrally attached to the wall 54*c*, for example. In one embodiment, the nozzle cylindrical wall and/or inner wall comprise a plastic material. The inner wall 55 assists the cylindrical nozzle wall 54*c* to stably maintain the motor assembly 18*c* within the nozzle.

As shown, bristles may be placed on the top surface of the end wall 104*c* of the brush head, for example. Also as shown, screws 146, 148 may be employed to affix the motor assembly 18*c* to nozzle 20*c*. A screw may also be coupled to (i) a washer 148 seating the receptacle 38*c* of the electrical connection on the motor or to (ii) another portion of the motor assembly. In FIG. 10, receptacle 38*c* is interlockingly coupled to plug 36*c* as discussed with regard to FIG. 1.

Furthermore, as shown in FIG. 10, the holes may have angled rim surfaces 148, 150, as shown, thereby improving the suctioning of particles through the nozzle and into the hose. As shown in FIG. 10 (see also FIG. 5, for example), holes 21*c* may have substantially greater width than the length thereof, for example. This maximizes the amount of hole space employed while minimizing the length of the nozzle 20*c*, thereby increasing the ability of the nozzle assembly to turn corners within enclosed spaces, such as ducts. Thus, the holes of the present invention may be oriented longitudinally along the nozzle, as shown in the holes 21*b* of FIG. 9, for example, or perpendicular to the axis of the nozzle, for example, as shown in the holes 21*c* of FIG. 10 and holes 21*a* of FIG. 5.

Drive shaft 100*c* of FIG. 10 may be externally and internally threaded and receive the brush head thereon and the screw 102*c* therein and may be configured such as discussed with respect to drive shaft 100 and screw 102 of FIG. 5, for example.

As shown in FIG. 10, the distal end 52*c* of nozzle 20*c* is located proximally from a distal portion 44*c* of the motor assembly 18*c*. However, in another embodiment of a nozzle assembly (not shown), the motor assembly is disposed entirely or almost entirely within the walls of the nozzle and/or hose, making the nozzle/motor assembly combination shorter. In such an embodiment, the distal end 52*c* of the nozzle is in substantially the same plane as distal portion 44*c* of the motor assembly. Such a nozzle is an additional example of a means for coupling the motor assembly to the hose. In one such embodiment (not shown), the end wall 104*c* of the brush head is mounted adjacent the distal end 52*c* of the nozzle while the proximal end of the brush head is mounted adjacent wide holes in the nozzle. In this embodiment, the length of the nozzle is minimized to further allow the assembly to readily turn comers within ducts.

The bristles of the present invention may be coupled to the brush head in a variety of different manners, such as by being tied in, glued in, or stapled in, for example. The bristles may be located on the sides and/or top of the brush head. For example, in one embodiment, the brushes shown in FIGS. 5–9 have bristles on the top portions thereof.

As shown in FIGS. 7–10, in one embodiment, the brush head comprises a hollow member having bristles on the exterior surface thereof. Since the brush head is a hollow member, the brush head can encapsulate at least a portion of the motor assembly and/or nozzle, thereby making the use of space more efficient.

Nozzles 20–20*c* are each examples of means for coupling a motor assembly to a hose. However, a variety of different nozzles may be employed in the present invention, such as nozzles having different shapes and configurations each of which may be additional examples of means for coupling the motor assembly to the hose.

In the motorized nozzle assemblies illustrated in FIGS. 1–10, the brush, motor assembly and nozzle are aligned such that the brush, motor assembly and nozzle have substantially the same longitudinal axis. Thus, the brush, motor assembly and nozzle are in line, providing an efficient and compact design.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A motorized vacuum nozzle assembly configured to suction particles from within an enclosed space, the vacuum nozzle assembly adapted for coupling to a hose of a vaccum assembly at a leading end of the hose used for cleaning and vacumming the enclosed space, and comprising:

an electrical motor assembly configured to move a cleaning member, thereby removing particles from surfaces contacted by the cleaning member; and means for coupling the motor assembly to the leading end of the hose of the vacuum assembly;

wherein the means for coupling has at least one opening therethrough located to the rear of the electrical motor assembly, such that particles can be suction through the at least one opening and into a hose of a vacuum assembly.

2. An assembly as recited in claim 1, wherein mean for coupling comprises a nozzle having a plurality of openings in a wall thereof.

3. An assembly as recited in claim 1, wherein the means for coupling comprises a nozzle having an opening in the distal end thereof and in the wall thereof, the motor assembly being positioned within the opening in the distal end of the nozzle.

4. An assembly as recited in claim 1, wherein the motor assembly is bi-directional.

5. A motorized vacuum nozzle assembly adapted for coupling to a hose of a vacuum assembly at a leading end of the hose used for cleaning and vacuuming an enclosed space into which the hose and nozzle assembly are inserted, the vacuum nozzle assembly comprising:

an electrically reversible motor assembly configured to rotate a cleaning member in either one of two directionally opposite rotations, either of which rotations will result in the cleaning member's removal of particles from surfaces contacted by the cleaning member, a nozzle having a proximal end, a distal end, and a wall extending therebetween, the distal end of the nozzle coupled to the motor assembly assembly; and wherein the nozzle has at least one opening through the wall thereof located to the rear of the electrical motor assembly, such that particles can be suctioned through the at least one opening of the nozzle.

6. An assembly as recited in claim 5, wherein the enclosed space is an air duct.

7. A motorized vacuum nozzle assembly configured to contact and suction particles from within an enclosed space, the vacuum nozzle assembly comprising:

a cleaning member comprising a hollow head, and having a proximal end and a distal end;

an electrical motor assembly configured to move the cleaning member upon actuation of the motor assembly, thereby removing particles from surfaces contacted by the cleaning member; and means for coupling the electrical motor assembly to a hose of a vacuum assembly, the means for coupling having at least one opening therethrough such that particles contacted by the cleaning member can be suctioned through the at least one opening and into a hose of a vacuum assembly.

8. An assembly as recited in claim 7, wherein the distal end of the electrical motor assembly is coupled to the cleaning member.

9. An assembly as recited in claim 7, wherein the distal end of the electrical motor assembly is coupled to the proximal end of the cleaning member.

10. An assembly as recited in claim 7, wherein the cleaning member comprises a rotating brush that stabilizes the electrical motor assembly while the nozzle assembly is within an enclosed space.

11. An assembly as recited in claim 7, wherein the means for coupling has (i) an opening at a distal end thereof for receiving the electrical motor assembly and (ii) an opening proximal end thereof for coupling to a hose.

12. An assembly as recited in claim 7, wherein the cleaning member is selectively coupled to the electrical motor assembly.

13. An assembly as recited in claim 7, wherein the electrical motor assembly is selected from the group consisting of a battery-operated motor assembly and a cord-operated motor assembly.

14. A motorized vacuum nozzle assembly configured to contact and suction particles from within an enclosed space, the vaccum nozzle assembly comprising:

a cleaning member having a proximal end and a distal end;

a motor assembly configured to move the cleaning member upon actuation of the motor assembly, thereby removing particles from surfaces contacted by the cleaning member; and a nozzle having a proximal end, a distal end, and a wall extending therebetween, the distal end of the nozzle coupled to the motor assembly assembly, wherein the nozzle has at least one opening through the wall thereof, the width of the hole through the wall being substantially greater than the length of the hole through the wall such that particles contacted by the cleaning member can be suctioned through the at least one opening of the nozzle.

15. An assembly as recited in claim 14, wherein the proximal end of the nozzle is configured to couple to a hose of a vacuum assembly, wherein the nozzle has at least one opening through the wall thereof, such that particles contacted by the cleaning member can be suctioned through the at least one opening of the nozzle and into a hose of a vacuum assembly.

16. An assembly as recited in claim 14, wherein the brush, motor assembly and nozzle have substantially the same longitudinal axis.

17. A motorized vacuum nozzle assembly configured to couple to a vacuum hose of a vacuum assembly, the vacuum nozzle assembly comprising:

a brush comprising a brush head and a plurality of bristle extending therefrom;

a motor assembly coupled to the brush head such that actuation of the motor assembly causes the brush head to rotate;

wherein the brush read of the brush encapsulates the distal end of the motor assembly; and a nozzle having a proximal end having a proximal opening, a distal end having a distal opening, and a cylindrical wall extending therebetween, a portion of the motor assembly being positioned within the distal end of the nozzle, wherein the nozzle has at least one opening through the cylindrical wall thereof, such that particles contacted by the brush can be suctioned through the at least one opening of the cylindrical wall and into a hose of a vacuum assembly.

18. An assembly as recited in claim 17, wherein the brush head comprises a hollow member having bristles extending from an exterior portion thereof.

19. An assembly as recited in claim 17, further comprising an inner wall extending from the cylindrical wall.

20. A vacuum assembly, comprising:

a vacuum source;

a transfer station communicating with the vacuum source; and a motorized vacuum nozzle assembly communicating with the transfer station, the vacuum nozzle assembly comprising:

a vacuum nozzle having a proximal end, an opposing distal end, a cylindrical wall extending between the proximal and distal ends, and at least one opening extending through the cylindrical wall;

a motor assembly coupled to the distal end of the nozzle; and a cleaning member that can be moved upon actuaction of the motor assembly, such that upon actuation of the motor assembly and the vacuum source, particles contacted by the cleaning member are suctioned through the at least one opening, through the transfer station and into the vacuum source.

21. An assembly as recited in claim 20, wherein a flexible hose couples the nozzle assmbly to the transfer station an wherein a flexible hose couples the transfer station to the vacuum source.

22. An assembly as recited in claim 20, wherein the transfer station has a compartment and first and second vacuum ports in fluid communication with the compartment and wherein particles flow from the first port, through the compartment, and out the second port.

23. An assembly as recited in claim 20, wherein the transfer station further comprises a third port in fluid communication with one of (i) the compartment; and (ii) the second port; such that a fluid can be deposited into the third port.

24. A motorized vacuum nozzle assembly adapted for coupling to a hose of a vacuum assembly at a leading end of the hose used for cleaning and vacuuming an enclosed space into which the hose and nozzle assembly are inserted, the vacuum nozzle assembly comprising:

a cleaning member having a proximal end and a distal end;

an electrical motor assembly comprising a battery pack and having a distal end selectively coupled to the cleaning member;

a nozzle having a proximal end, a distal end, and a wall extending therebetween, the distal end of the nozzle coupling to the motor assembly; and wherein the nozzle has at least one opening through the wall thereof located to the rear of the electrical motor assembly such that particles contacted by the cleaning member can be suctioned through the at least one opening of the nozzle.

25. A vacuum system for cleaning and vacuuming an enclosed space such as a duct, pipe or chimney, the vacuum system being couplable to a remote vacuum source and comprising:

flexible hose means for vacuuming dust, dirt or debris from the enclosed space, comprising one end that is connectable to the remote vacuum source and another leading end for insertion into the enclosed space;

a nozzle comprising proximal and distal ends, the proximal end being connectable to the leading end of the flexible hose means;

an electrical motor assembly coupled to and generally enclosed within the distal end of the nozzle; and a rotatable cleaning brush connected to the electrical motor assembly.

26. A vacuum system as defined in claim 25, wherein the flexible hose means is comprised of first and second pieces of flexible hose, and wherein the vacuum system further comprises a transfer station, connected between the first and second pieces of flexible hose, said transfer station providing a means for coupling suction provided by the remote vacuum source between the first and second pieces of flexible hose.

27. A vacuum system as defined in claim 26 wherein the transfer station comprises means, connectable to a water source, for creating a water jet that mystifies water and breaks down vacuumed particles such that it is collectable as a slurry.

28. A vacuum system as defined in claim 26 wherein the transfer station comprises a carriage mounted on wheels.

29. A vacuum system as defined in claim 26 wherein the transfer station comprises means for selectively releasing compressed air to create a forced air stream within the second piece of flexible hose for the purpose of selectively helping to loosen dirt and dust particles within the enclosed space.

30. A vacuum system as defined in claim 25 wherein the electrical motor assembly comprises a battery pack for providing power to the electrical motor assembly.

31. A vacuum system as defined in claim 25 further comprising an electrical cord for connecting the electrical motor assembly to a source of electrical power.

32. A vacuum system as defined in claim 31, wherein the flexible hose means is comprised of first and second pieces of flexible hose, and wherein the vacuum system further comprises a transfer station, connected between the first and second pieces of flexible hose, said transfer station providing a means for coupling suction provided by the remote vacuum source between the first and second pieces of flexible hose, and wherein the transfer station comprises a transformer connected to the electrical cord, and a electrical cord connectable to an electrical wall outlet for providing power to the transformer.

33. A vacuum system as defined in claim 32, wherein the electrical motor assembly is bi-directional so that the rotatable cleaning brush can be rotated in either of two opposition directions, and further comprising a remote control system for remotely controlling at the transfer station turning the electrical motor assembly on or off, and for remotely controlling the direction of rotation of the rotatable cleaning brush.

34. A vacuum system as defined in claim 30 or 31 wherein the electrical motor assembly is bi-directional so that the rotatable cleaning brush can be rotated in either of two opposition directions.

35. A vacuum system as defined in claim 25 wherein the nozzle comprises an opening located essentially behind the electrical motor assembly so as to be generally unobstructed by tho electrical motor assembly to permit suctioning to occur through said opening.

* * * * *

UNITED STATES PATENT AND TRADEMARK OFFICE

CERTIFICATE OF CORRECTION

PATENT NO. : 6,813,810 B2 
DATED : November 9, 2004
INVENTOR(S) : Merlin D. Beynon It is certified that error appears in the above-identified patent and that said Letters Patent is hereby corrected as shown below:

Title page,
Item [56], References Cited, OTHER PUBLICATIONS, "Website for Janex Products," second occurrence, change "Equimpment," to -- Equipment, --

Drawings,
Sheet 2, Figure 3, replace with the following drawing:

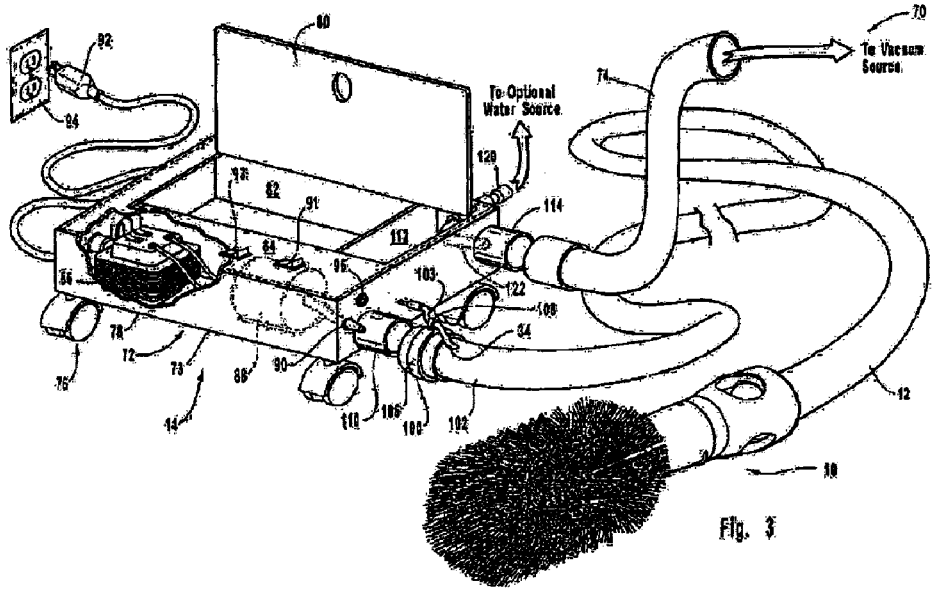

Column 1,
Line 24, before "and remain within" change "within" to -- into --
Line 60, before "high speed rotating shaft." insert -- the --

Column 3,
Line 28, change "cross sectionally" to -- cross-sectionally --

Column 4,
Line 36, before "enclosed space" insert -- an --

Column 5,
Lines 20 and 21, after "proximal end 50 of nozzle" insert -- 20 --

Column 6,
Line 35, change "right hand rotation)" to -- left hand rotation) --

UNITED STATES PATENT AND TRADEMARK OFFICE

CERTIFICATE OF CORRECTION

PATENT NO. : 6,813,810 B2
DATED : November 9, 2004
INVENTOR(S) : Merlin D. Beynon It is certified that error appears in the above-identified patent and that said Letters Patent is hereby corrected as shown below:

Column 7,
Line 7, before "sonic pulsating air." remove "a"

Column 8,
Line 4, change "inspected" to -- inspection --
Line 18, after "transfer station" insert -- 14 --
Line 67, after "cleaning member" change "16A" to -- 10A --

Column 10,
Line 7, change "screws 146,148" to -- screws 144, 146 --

Column 11,
Line 26, change "suction" to -- suctioned --
Line 48, after "cleaning member" change "," to -- ; --

Column 12,
Line 58, change "plurality of bristle" to -- plurality of bristles --

Column 13,
Line 33, after "transfer station" change "an" to -- and --

Column 14,
Line 52 and 61, change "opposition" to -- opposite --
Line 64, before "electrical motor" change "tho" to -- the --

Signed and Sealed this

Twelfth Day of July, 2005

JON W. DUDAS
*Director of the United States Patent and Trademark Office*